US006981752B2

(12) United States Patent
Harn et al.

(10) Patent No.: US 6,981,752 B2
(45) Date of Patent: Jan. 3, 2006

(54) FRONT PANEL MOUNTING DEVICE FOR A DRAWER

(75) Inventors: Lian Lam Harn, Perak (MY); Yan Lam Harn, Perak (MY)

(73) Assignee: Harn Marketing Sdn Bhd, Perak (MY)

( * ) Notice: Subject to any disclaimer, the term of this patent is extended or adjusted under 35 U.S.C. 154(b) by 93 days.

(21) Appl. No.: 10/440,414

(22) Filed: May 19, 2003

(65) Prior Publication Data

US 2004/0000852 A1 Jan. 1, 2004

(30) Foreign Application Priority Data

May 20, 2002 (MY) ..... PI20021844

(51) Int. Cl.
*A47B 88/00* (2006.01)

(52) U.S. Cl. ..... 312/348.4

(58) Field of Classification Search ..... 312/330.1, 312/348.1, 348.2, 348.4, 263, 265.5; 403/321, 403/323, 325, 322.1, 322.4
See application file for complete search history.

(56) References Cited

U.S. PATENT DOCUMENTS

| | | | | |
|---|---|---|---|---|
| 4,705,328 A | | 11/1987 | Rock et al. | 312/330.1 |
| 5,281,022 A | * | 1/1994 | Rock | 312/348.4 |
| 5,466,061 A | * | 11/1995 | Lautenschlager | 312/348.2 |
| 5,664,857 A | * | 9/1997 | Lautenschlager et al. | 312/348.4 |
| 5,688,033 A | * | 11/1997 | Fleisch et al. | 312/348.4 |
| 6,027,194 A | * | 2/2000 | Fleisch | 312/348.4 |
| 2004/0000849 A1 | | 1/2004 | Lam Harn et al. | 312/330.1 |

FOREIGN PATENT DOCUMENTS

| | | | |
|---|---|---|---|
| DE | 3024972 | | 1/1982 |
| DE | 3030199 | | 3/1982 |
| EP | 581325 | * | 2/1994 |
| EP | 0740917 | | 7/1994 |
| GB | 2193084 | | 2/1988 |

* cited by examiner

*Primary Examiner*—James O. Hansen
(74) *Attorney, Agent, or Firm*—Volpe and Koenig, P.C.

(57) ABSTRACT

An improved mounting device to secure a front panel in perpendicular relationship onto a side panel comprises of a mounting bracket (18) secured to the front panel (12) and a receiving bracket (20) assembly secured to the side panel (14) said front and side panel (12,14) forming part of a furniture. The improvements further includes the mounting bracket (18) with a nose edge (32) removeably secured onto the receiving bracket assembly (20), the receiving bracket assembly (20) comprises of a holding block (60) to receive in registration the nose edge (32), a slider (70) to securely hold the mounting bracket (18) and to allow linear movement of the mounting bracket (18) within the receiving bracket (20), a rotatably mounted actuator plate (80), a biased means pivotally mounted to tension the actuator plate (80) and wherein by adjusting the actuator plate (80) and an eccentric cam mechanism means (110) the front panel (12) can be adjusted in two perpendicular axes in relation to the side panels (14).

8 Claims, 10 Drawing Sheets

FRONT PANEL MOUNTING DEVICE FOR A DRAWER

FIELD OF THE INVENTION

The present invention relates to an improved mounting device to securely and quickly mount a first panel member of furniture in a perpendicular relationship to a second panel member of the a furniture unit. The present invention more particularly relates to a mounting device and a method thereof to securely and quickly mount a front panel of a drawer to a pair of parallel sidewalls of the said drawer.

BACKGROUND OF THE INVENTION

A panel-mounting device for a drawer is known from AT-PS 391 406. One of the problems in the prior art mounting mechanism or drawer is that the position of the front panel in relation to the drawer side panels is not adjustable after the front panel is fixed to the drawer side panels. Alternatively complex mechanical devices are provided to achieve this objective. The purpose of such a panel-mounting device is to adjustably secure a front panel onto the drawer in a perpendicular relationship so that when an item of furniture is assembled, the position of the front panel may be adjusted in a lateral and/or vertical direction. The panel-mounting device should also allow the front panels to be assembled quickly and securely to the drawers.

SUMMARY OF THE INVENTION

The objective of the present invention is to provide an improved front panel mounting device to enhance the mounting mechanism of a front panel to a drawer side panel.

It is a further objective of the present invention to provide a panel-mounting device, which can be mounted onto the drawer side panels quickly and where the front panel is horizontally and/or vertically adjustable during or after installation.

The improved mounting device is configured with the objective of holding the front panel (for example a drawer) firmly against the side panels (of the drawer). When a mounting bracket is fixed on the inner face of the front panel and inserted inside the receiving bracket, which is mounted onto the side panels (of the drawer), the front panel is firmly held against the side panels.

The present invention, an improved mounting device to secure a front panel in perpendicular relationship onto a side panel comprises of a mounting bracket secured to the front panel and a receiving bracket assembly secured to the side panel. The front and side panel forms pact of a furniture. The present invention includes the mounting bracket with a nose edge removeably secured onto the receiving bracket assembly, the receiving bracket assembly comprises of a holding block to receive in registration the nose edge, a slider to securely hold the mounting bracket and to allow linear movement of the mounting bracket within the receiving bracket, a rotatably mounted actuator plate, a biased means pivotally mounted to tension the actuator plate and wherein by adjusting the actuator plate and an eccentric cam mechanism means, the front panel can be adjusted in two perpendicular axes in relation to the side panels.

The nose edge of the mounting bracket includes a bottom face, a locking face and a clamping face and wherein grooves are provided on the clamping face. The holding block includes a recessed portion with grooves. The slider includes an angular face corresponding to the locking face of the nose edge and wherein when the front panel is securely clamped to the side panels, both the angular face and the locking face are in registration.

The slider is provided with an opening and wherein a swing arm of the actuator plate is inserted therein. A second tail end of the actuator plate is pivotally biased against a spring mechanism holding body in such that when the spring mechanism holding body is in a first position, the swing arm of the actuator plate and the slider are distal to the mounting bracket and when the spring mechanism holding body is rotated to a second position, the swing arm and the slider are proximate to the mounting bracket, and wherein in the first position the slider and the locking face of the mounting bracket are not locked in position and in the second position the slider and the locking face of the mounting bracket are in a locked position.

The eccentric cam mechanism is operable to adjust the front panel in one linear movement. The actuator plate is operable to adjust the front panel in a perpendicular direction to the direction of movements above.

DETAILED DESCRIPTION OF THE INVENTION

Figure 1:
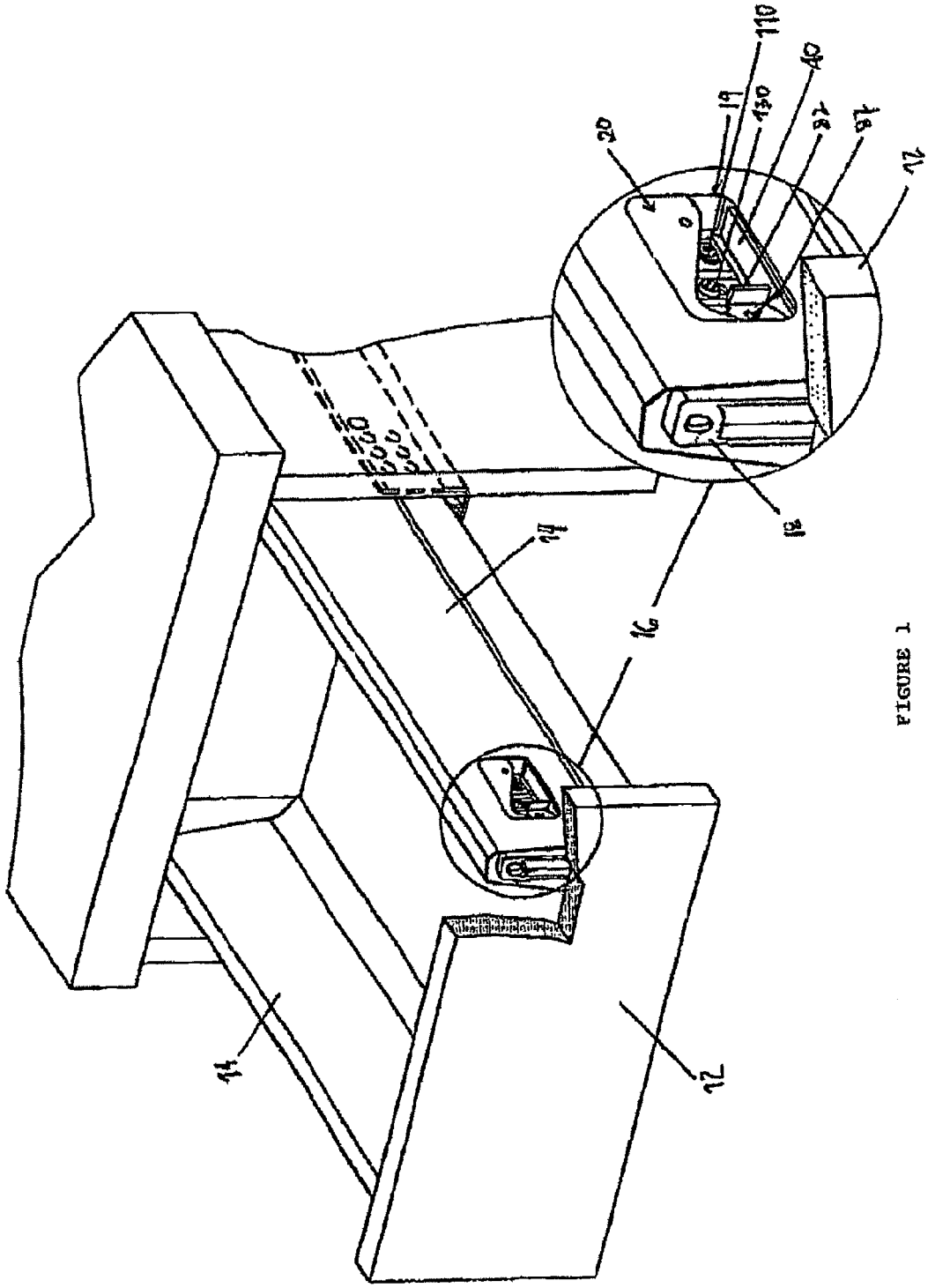
FIG. 1 shows a perspective view of a front panel mounted to a drawer by using the present mounting device.
Figure 14:
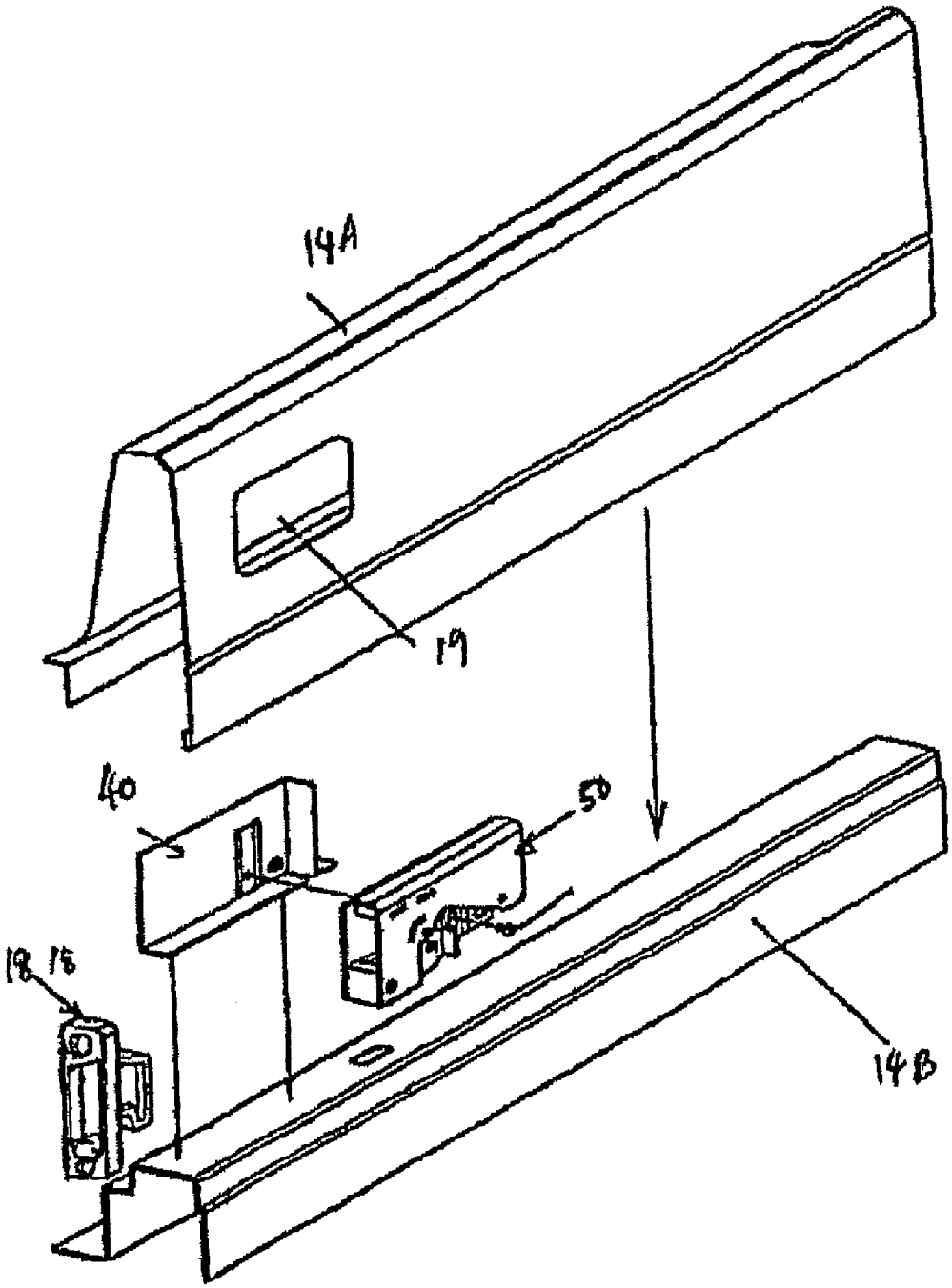
FIG. 14 shows a perspective view of the upper and bottom panel of the side panels of the present invention.

FIG. 1 illustrates a drawer (10), which includes a front panel (12), fastened to two parallel sidewalls (14) by means of a fastening device (16) of the present invention. Each of the said sidewall (14) can be dismantled into separate members, defined as an upper panel (14A) and a bottom panel (14B). In the present invention it is preferred that the upper panel (14A) is provided with an opening (19) on its side surface. The said sidewalls of the present invention are preferably made of rigid structure such as steel, wood, plastics, metal or other rigid material such as chipboard, fiberboard and etc (FIGS. 1 & 14).

The fastening device (16) comprises of a mounting bracket (18) and a receiving bracket (20). The said mounting bracket (18) is mounted onto the front panel (12) by screw means wherein the mounting bracket (18) is positioned extending perpendicularly to the front panel (12). The said receiving bracket (20) is positioned in a cavity created in the upper panel (14A) or at the bottom panel (14B) in the event the upper panel is of hollow section, (FIG. 1).

Figure 2:
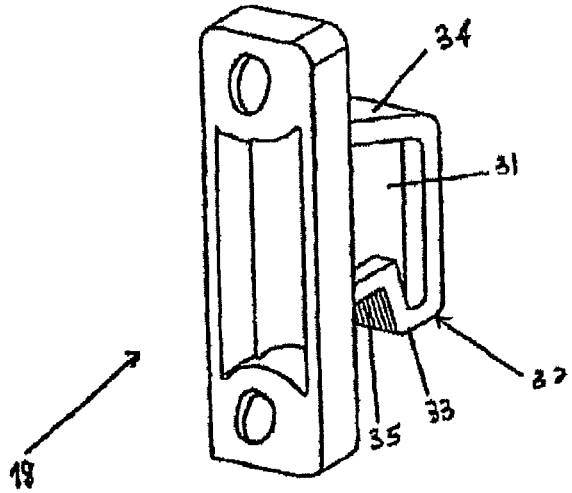
FIG. 2 shows a perspective view of a mounting bracket of the present invention.
Figure 3:
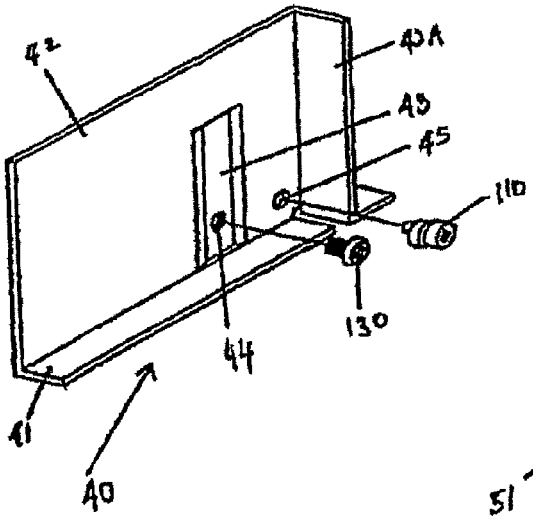
FIG. 3 shows a perspective view of an angle plate of the receiving portion.

The said mounting bracket (18) comprises of a first flange (30) and a second flange (31). The first flange (30) is provided with a clamp means for attaching to the front panel (12). The second flange (31) is positioned perpendicular to the first flange (30). The lower edge portion of the second flange (31) is provided with a nose edge (32). The nose edge (32) further includes a bottom face (33), a locking face (34) and a clamping face (35). The clamping face (35) is further provided with a plurality of vertical serration, whose function will be described later, (FIG. 2).

Figure 4:
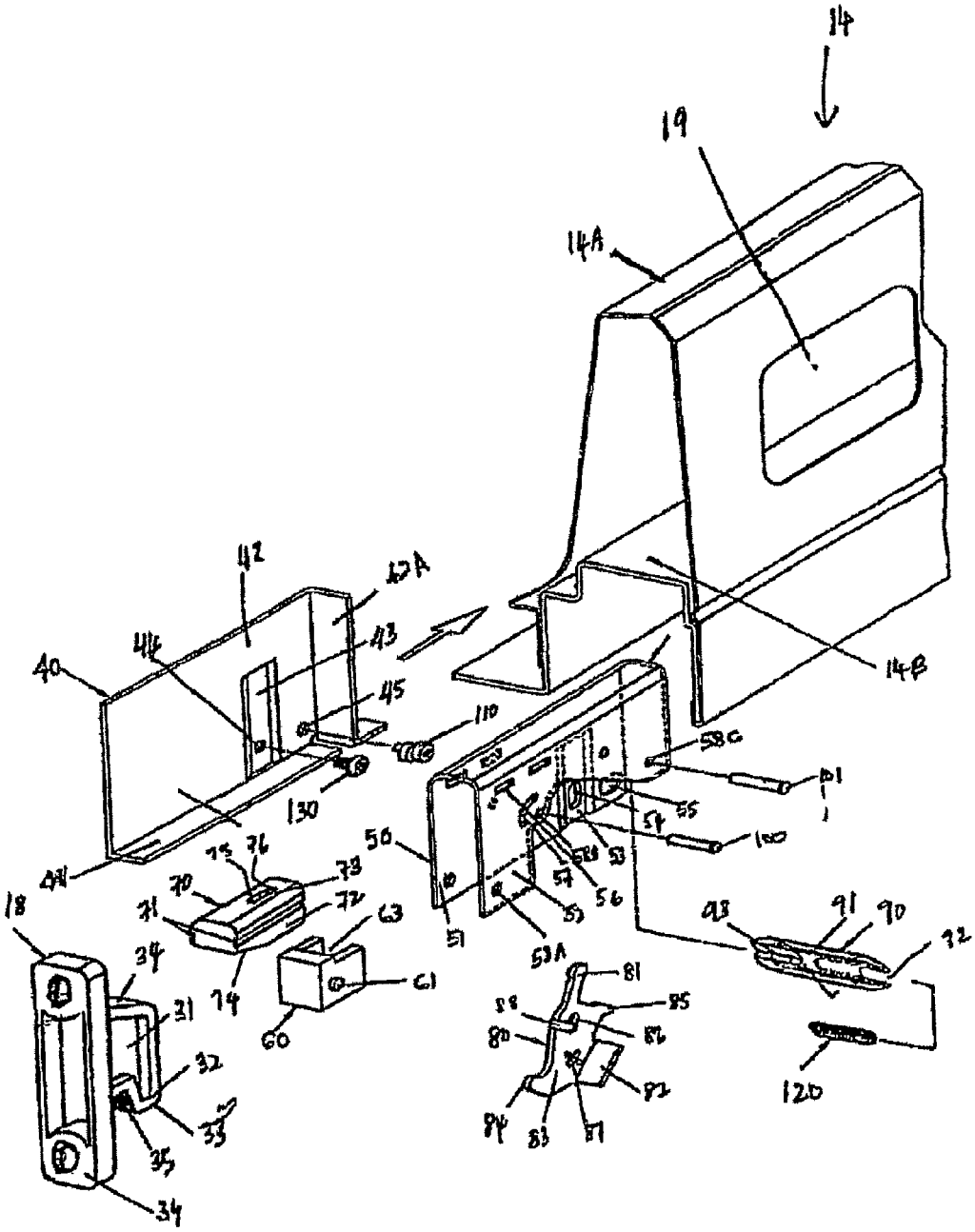
FIG. 4 shows an exploded view of the mounting bracket, the angle plate, the cover plate, the sidewall of the drawer and other components parts.

The receiving bracket (20) comprises of an angle plate (40) and a cover plate (50) assembled together. The cover plate (50) houses a holding block (60), a slider (70), an actuator plate (80), a set of pivot pins (100,101), an eccentric cam mechanism means (110), a spring mechanism (120), a spring holding body (90) and a screw means (130). Each of the above-mentioned features will be described in detail now, (FIG. 4).

The angle plate (40) is provided with a first flange (41) and a second flange (42). Both the first and second flange (41,42) are positioned perpendicular to each other. The first flange (42) is provided with a recess portion (43). The recess portion (43) is further provided with a first opening (44), wherein the first opening (44) is internally threaded. The second flange (42) is also provided with a second opening (45) wherein the second opening (45) is provided to receive the eccentric cam mechanism means (110). The first flange (41) of the angle plate (40) is mounted to the upper surface of the bottom panel of the sidewall (14B), (FIG. 14). A third flange (42A) is provided to the first flange (41) and is used as a cover to cover the cover plate (50) upon assembly.

Figure 5:
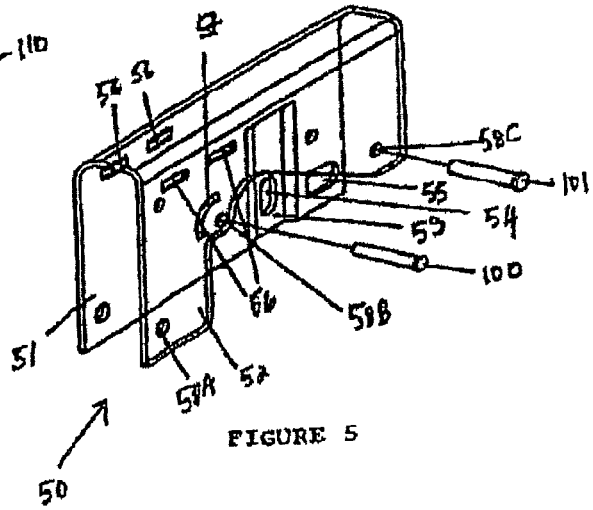
FIG. 5 shows a perspective view of a cover plate of the receiving portion.

The cover plate (50) is a 'V' shaped structure with a first vertical face (51) and a second vertical face (52). Both the first and second vertical faces (51,52) are continuous and are integral unit and are positioned parallel to each other. The first vertical face (51) is provided with a recess portion (53) and wherein an oblong shaped opening (54) is provided therein. The first vertical face (51) is further provided with a guide opening means (55). The guide opening means (55) is designed to receive and guide the eccentric cam mechanism means (110) into the second opening (4.5) of the angle plate (40). A plurality of projection guide means (56) are provided on both the first and second vertical faces (51,52) of the cover plate (50). The projection guide means (56) are designed in such a manner that, the projecting portion of the projection guides means on the first vertical face (51) protrude, facing the other projection guide means (56) of the second vertical face (52) and vice versa. The second vertical face (52) is further provided with a guide slot (57). Both the first and second vertical faces (51,52) are provided with a plurality of identical openings (58A, 58B, 58C), (FIG. 5).

Figure 6:
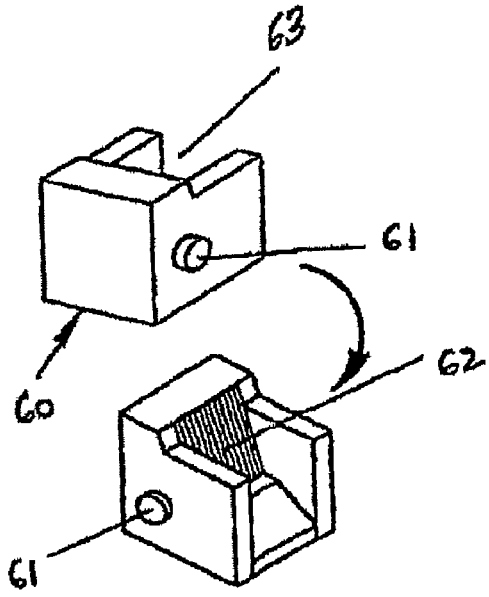
FIG. 6 shows a perspective top and bottom view of a holding block.

The holding block (60) is provided with locators (61) on each vertical face of the holding block (60). The holding block is further provided with a receiving portion (62) and wherein a plurality of vertical serrations are provided therein. The said receiving portion (62) is positioned in a recess bracket (63) provided on the holding block (60) and whose width is larger then the width of the nose edge (32) of the mounting bracket (18). The recess bracket (63) is designed and configured to receive and laterally adjust the mounting bracket (18) when the front panel is being mounted to the drawer, (FIG. 6).

Figure 7:
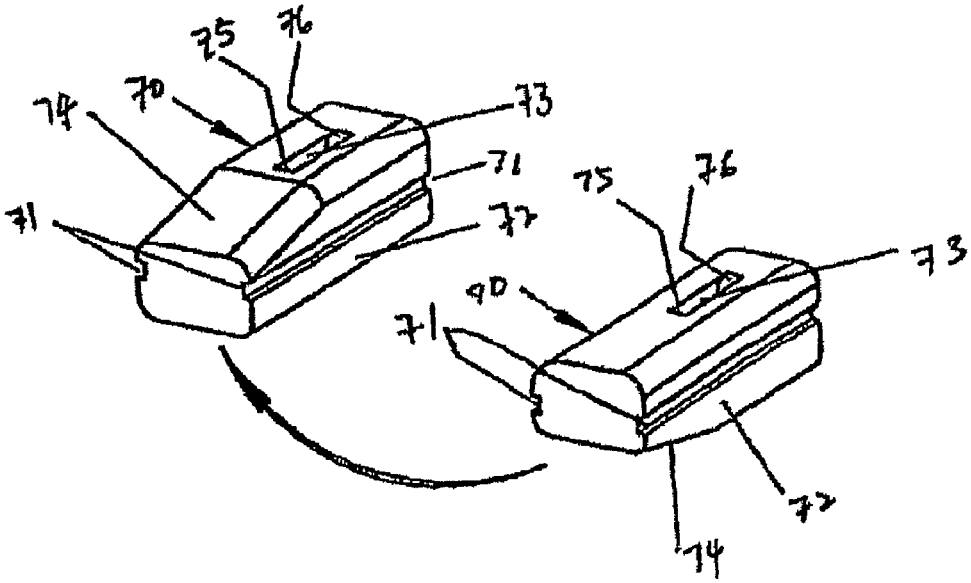
FIG. 7 shows a perspective top and bottom view of a slider.

The slider (70) is a substantially rectangular block with one inner edge tapered off, and is provided with grooves as guide track (71) on either sides of its vertical face (72). The function of the said guide track (71) is to guide the slider (70) along the first and second vertical faces (51,52) when the slider is introduced into the cover plate (50). The slider (70) is further provided with a vertically positioned opening (73). Said vertical opening (73) is positioned perpendicular to an angularly positioned face (74) (hereinafter referred as an angular face) of the slider (70). The inner portion of the vertical opening (73) is provided with a first and second locking face (75,76) wherein both the locking faces (75,76) are positioned opposite of each other (FIG. 7).

Figure 8:
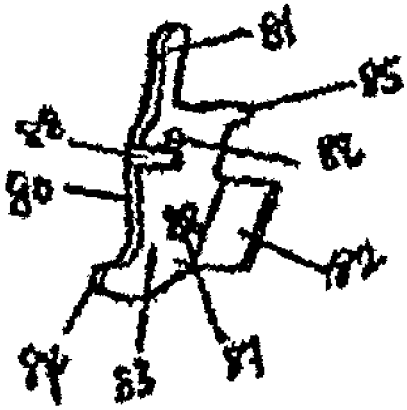
FIG. 8 shows a perspective view of an actuator of the present invention.

The actuator plate (80) is a rigid planar body with a swing arm (81) to move the slider forward and backwards when the slider and the actuator plate (80) are assembled together and a vertical flap (82). The combination of the vertical flap (82) and a flat face (83) in an assembly allows the front panel (12) upon mounting to be adjusted horizontally. The actuator plate (80) is also provided with a first and second tail end portions (84,85). The flat face (83) is further provided with an opening (86) and a screwdriver slot (87). Finally, the actuator (80) also includes a guide means (88), which is positioned perpendicularly to the flat face (83), (FIG. 8).

Figure 9:
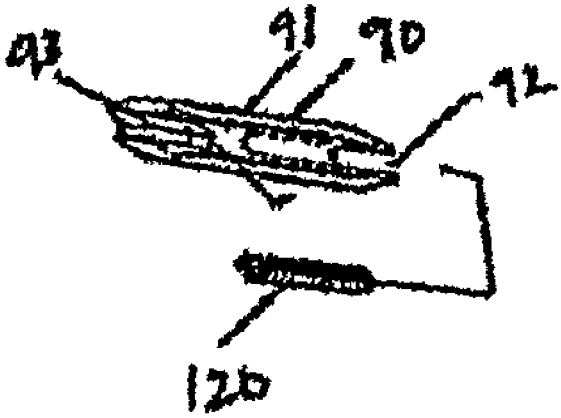
FIG. 9 shows a perspective view of a spring mechanism holding means of the present invention.

Finally, the spring holding body (90) is a finger like member and includes a first recess portion (91) to receive the helical spring (120) and a second recess portion (92) to receive the pivot pin (101). The spring holding body (90) is further provided with a V-shaped recessed edge wherein said pivot edge (93) is positioned at the mid edge portion of the spring holding body (90) and opposite the second recess portion (92), (FIG. 9)

Now, the manner each of the above mentioned components are assembled, the working mechanism of the present embodiment and other features not described earlier will be described now.

Firstly, the angle plate (40) is fastened onto the bottom panel (148) of the parallel sidewalls (14). The eccentric cam mechanism means (110) is then introduced and mounted to the vertical flange (42) of the angle plate (40). This arrangement allows the cover plate (SO) to be adjusted vertically when the front panel (12) is mounted to the drawer (10).

The components to be housed in the cover plate (50) are assembled together before the cover plate (50) is mounted onto the angle plate (40). Firstly, the holding block (60) is introduced and securely fastened between the first vertical face (51) and the second vertical face (52) of the cover plate (50). This is done by introducing the locators (61) of the holding block (60) into the opening (58A) of the cover plate (50), (FIG. 4).

Then the slider (70) is also introduced between the first vertical face (51) and the second vertical face (52) of the cover plate (50) by guiding the guide track (71) of the slider (70) into the projection guide means (56) of the cover plate (50), (FIG. 4).

The actuator plate (80) is then introduced between the first vertical face (51) and the second vertical face (52) of the cover plate (50). The swing arm (81) of the actuator (80) is positioned in the inner portion of the vertically positioned opening (73) of the slider (70). In this position, the guide means (88) is securely placed in the guide slot (57) of the cover plate (50). The pivot pin (100) is then introduced into the opening (58B) on the cover plate (50) and extending into the opening (86) on the actuator (80) to form a pivoted point for the actuator (FIG. 4).

Figure 10:
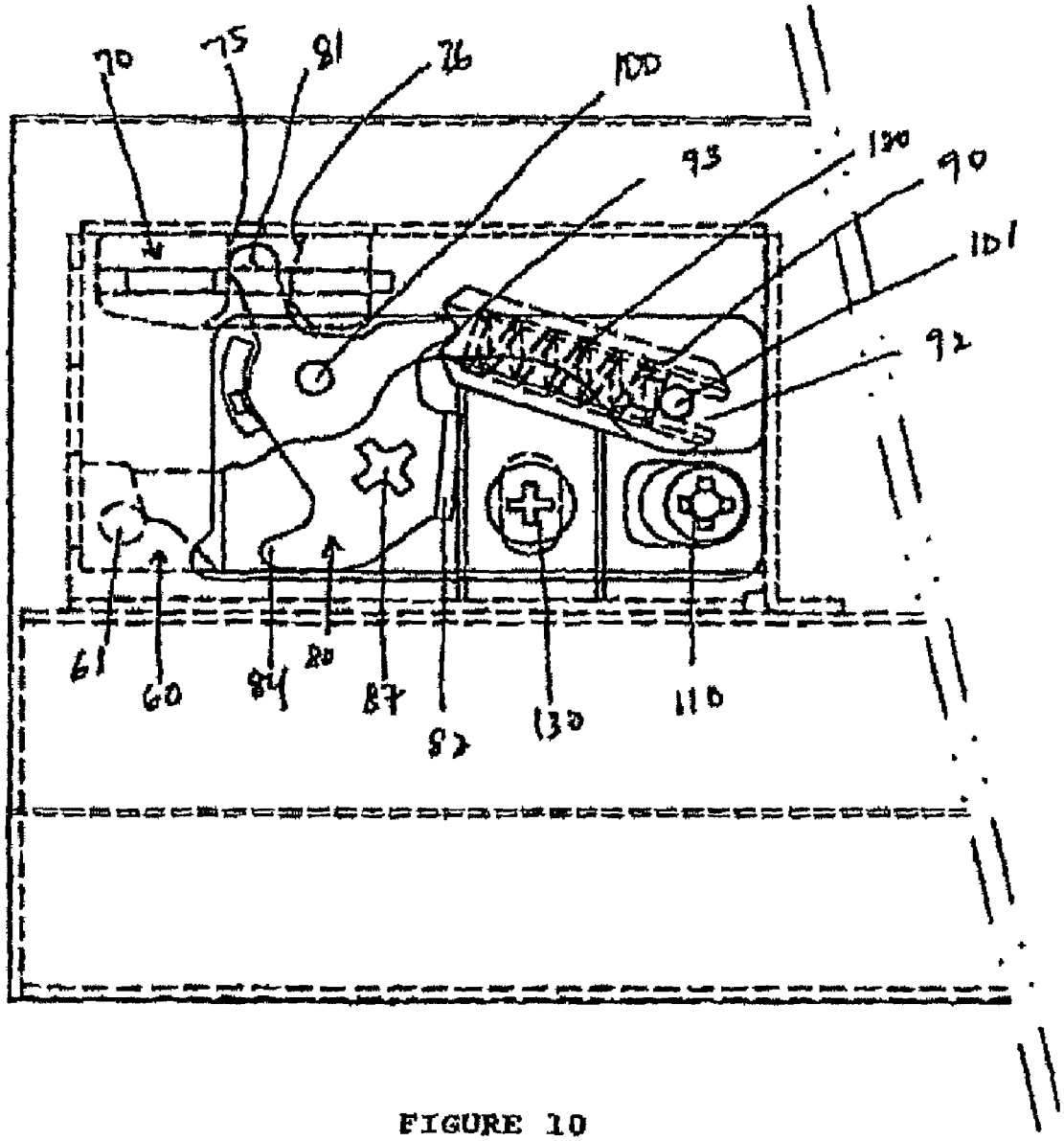
FIG. 10 shows a side cross-section view of the receiving portion in its first position.

The spring holding body (90) with the helical spring (120) mounted thereon is positioned in its predetermined positioned in such a manner that, the pivot edge (93) of the spring holding body (90) is in a physical contact with the second tail end (85) of the actuator. The other pivot pin (101) is then introduced into the opening (58C) of the cover plate (50). The pivot pin (101) compresses the helical spring (120) wherein the spring holding body (90) exerts force on the second tail end (85) of the actuator plate (80). The pivot pin (101) is permanently fixed to the spring holding body (90), preferably by riveting. When the slider (70) and the actuator (80) are in a nest position, the swing arm (81) of the actuator plate (80) will be physically in contact with the locking face (75) of the slider (70), (FIGS. 4 & 10). In other words, the receiving bracket (20) is now in a first position. Then the cover plate (50) with assembled components as foresaid is mounted onto the angle plate (40) in such a manner that, when the cover plate (50) is introduced to the angle plate (40) the recess portion (43) on the second flange (42) of the angle plate (40) and the recess portion (53) on the first vertical face (51) of the cover plate (50) are in a linear alignment with each other, (superimposed on each other). Then the screw means (130) is introduced into the oblong shaped opening (54) on the cover plate (50) and driven into the first opening (44) of the angle plate (40). The function of the screw means (130) is to firmly hold the cover plate (50) onto the angle plate (40), (FIG. 4).

When the receiving bracket (20) has been assembled and securely mounted onto the bottom panel of the parallel sidewall (14B), the upper panel of the parallel sidewall (14A) is placed onto the bottom panel (14B) and the upper panel is securely mounted to the bottom portion. On the other hand, the mounting bracket (18) is securely mounted onto the front panel (12) at its predetermined position. The above description only described the receiving portion (20) mounted to one of the parallel sidewalls (14) of the drawer (10). The other parallel sidewall (14) of the drawer (10) is also provided with an identical arrangement as described above.

Therefore, the drawer (10) is provided with a receiving bracket (20) on each of its sidewalls corresponding to each mounting bracket (18) mounted at each side of the front panel (12).

Figure 11:
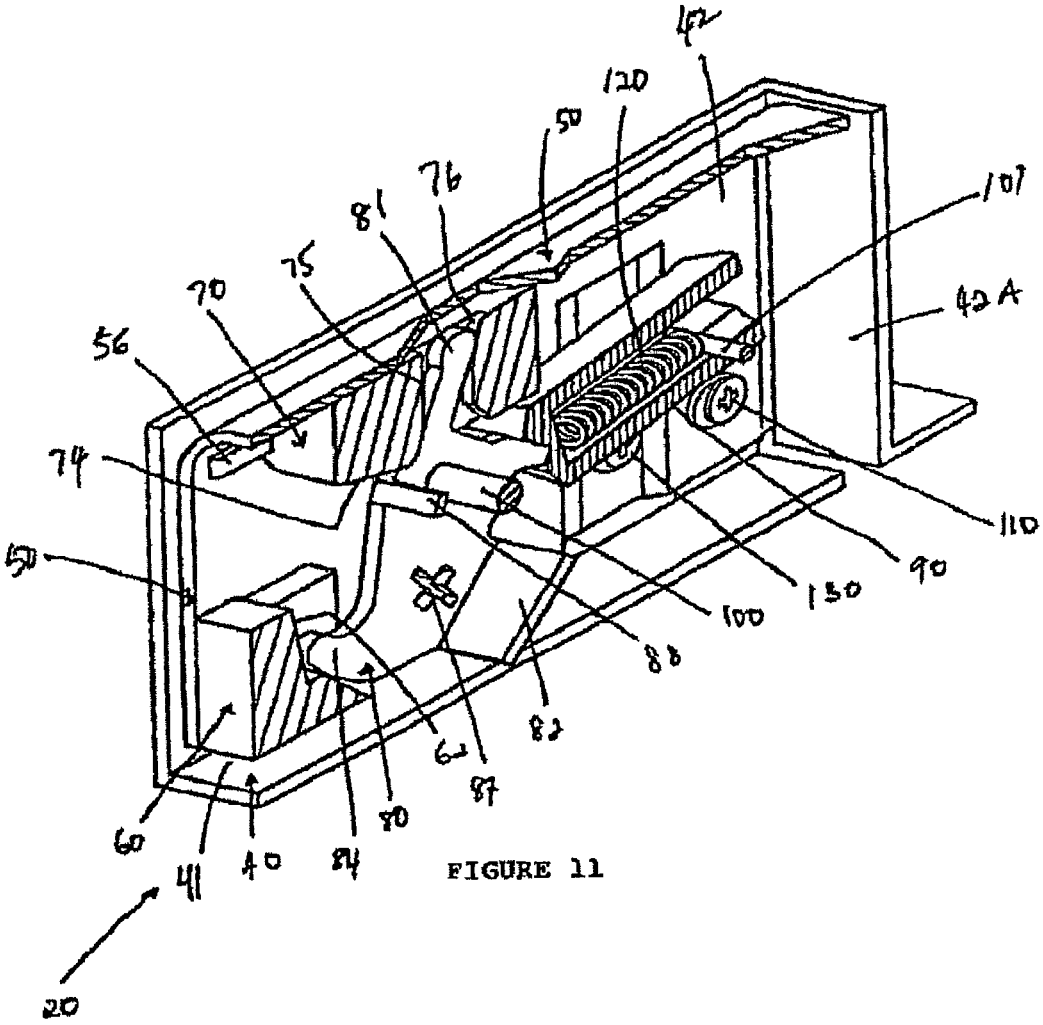
FIG. 11 shows a perspective view of the receiving portion in a second position.
Figure 12:
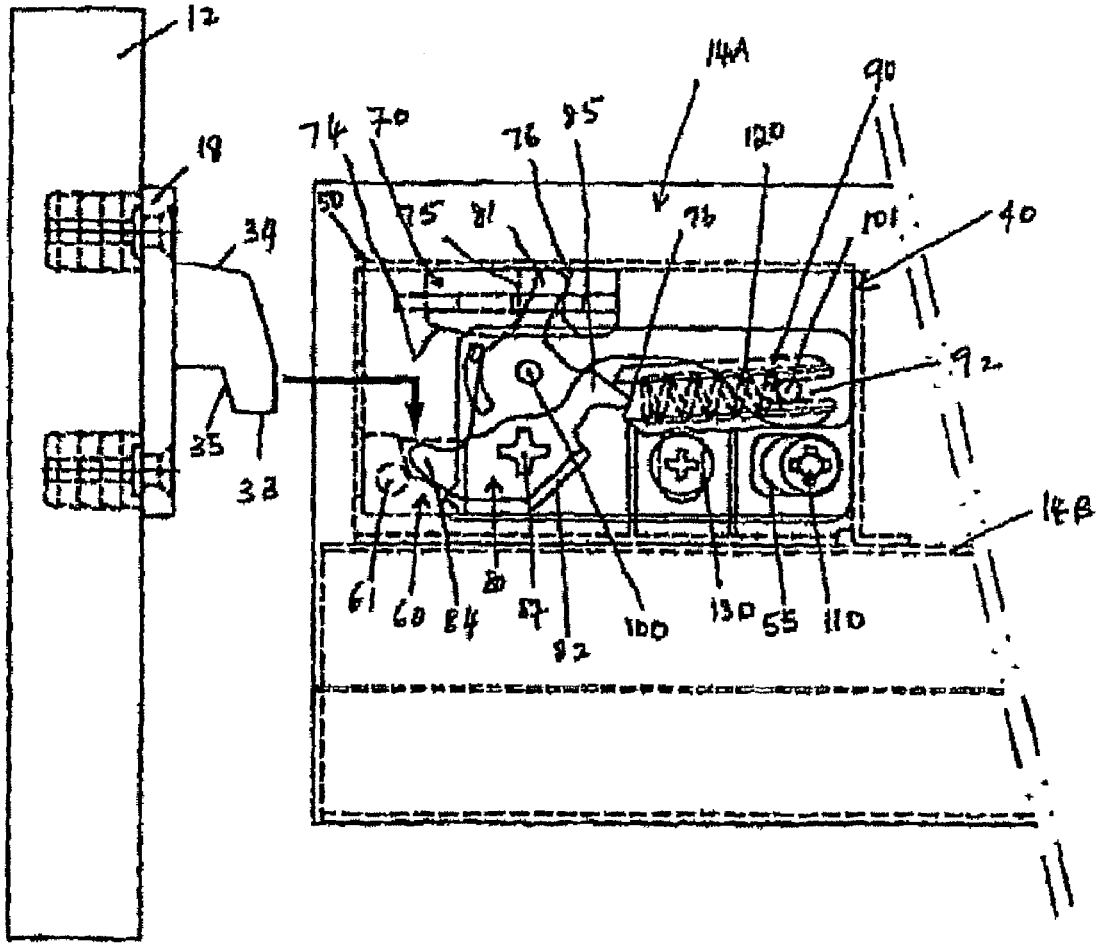
FIG. 12 shows a side cross-section view of the receiving portion in a second position.

Before the front panel (12) is mounted onto the drawer (10), the actuator plate (80) is rotated to its second position. This is done by inserting a screwdriver into the screwdriver slot (87) via the opening (19) provided on the upper panel of the sidewall (14A). In this second position the helical spring (120) exerts force onto the second tail end (85) of the actuator plate (80). In this second position the guide means (88) of the actuator plate (80) is rested on the guide slot (57) of the cover plate (50). In other words, the guide slot (57) acts as a stopper means to restrict further rotation of the actuator plate (80). In this position also, the slider (70) is pushed backwards to its second position towards the eccentric cam mechanism means (110) by the swing arm (81) of the actuator (80), (FIGS. 11 & 12). Now the receiving bracket (20) is in its second position.

The front panel (12) with the mounting bracket (18) mounted thereon by introducing the mounting bracket (18) into the receiving bracket (20). This is done by bringing the mounting bracket (18) in a linear alignment with the opening of the receiving bracket (20), moving the front panel into the receiving portion and then moving the front panel vertically downwards so that the nose edge (32) of the mounting bracket (18) is positioned in the recess bracket (63) of the holding block (60). The bottom face (33) on the nose edge (32) of the mounting bracket (18) will move the first tail end (84) of the actuator plate (80) which will result the actuator plate (80) to move back into its first position. At the same time, the swing arm (81) of the actuator plate (80) will move the slider (70) from its second position back into its first position. This is done by moving the locking face (75) of the slider (70) so that the angular face (74) of the slider (70) will slide over the locking face (34) of the mounting bracket (18), (FIGS. 11 & 12).

Figure 13:
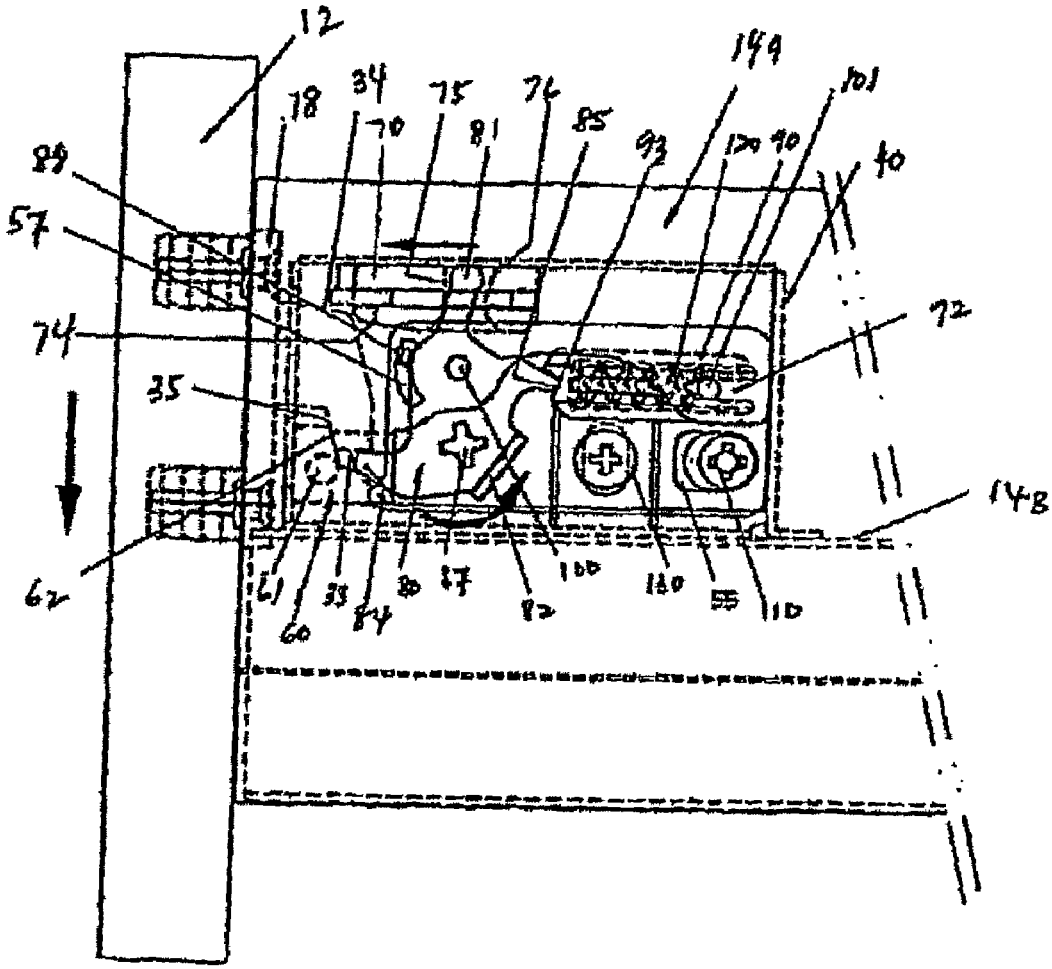
FIG. 13 shows a side cross-section view of the mounting bracket of the front panel placed in the receiving portion of the drawer.

When the front panel (12) is fully clammed onto the drawer (10), the angular face (74) of the slider (70) will slide over the locking face (34) of the mounting bracket (18) while the clamping face (35) of the mounting bracket (18) will slide over the receiving portion (62) of the holding block (60). In this position, the surface of the front panel (12) is fully in contact with the front portion of the drawer (10), (FIG. 13).

When the front panel (12) is being mounted to the drawer (to), the front panel (12) can be adjusted horizontally and vertically so that the front panel (12) is properly aligned with the drawer (10). To adjust the front panel (12) horizontally, lateral force is applied onto the vertical flap (82) of the actuator (80). This will result in the locking face (76) to be moved by the swing arm (81) of the actuator plate (80) from its present position. This will further result in the angular face (74) of the slider (70) to be released from the locking face (34) of the mounting bracket (18). Now the said front panel (12) can be horizontally adjusted. When the front panel (12) has been adjusted horizontally, lateral force applied on the vertical flap (82) is released and the front panel (12) is securely held in its position. At this position the angular face (74) of the slider (70) is biased against the locking face (34) of the mounting bracket (18). It will be appreciated that the grooves in both the angular face (74) and the locking face (34) will be in contact with each other in a tight manner to prevent any sliding or seepage. To adjust the front panel (12) vertically, the screw means (130) is loosened and the eccentric Cant mechanism means (110) is rotated (clockwise or anticlockwise) to move the front panel (12) vertically upwards and downwards. When the front panel (12) has been adjusted vertically the screw means (130) is securely screwed to hold the front panel (12) in its position.

To remove the front panel (12) from the drawer, lateral force is applied onto the vertical flap (82) of the actuator plat (80). This will result in the locking face (76) to be moved by the swing arm (81) of the actuator plate (80) from its present position. This will further result in the angular face (74) of the slider (70) to be released from the locking face (34) of the mounting bracket (18). The front panel (12) is then removed from the drawer (10). Another way to remove the front panel (112) from the drawer (10) is by inserting a screwdriver into the screwdriver slot (87) and rotating the actuator plate (80) into its first position. It is obvious that both the receiving bracket (20) on the drawer (10) have to work at the same time in order to adjust the front panel horizontally or vertically and when the front panel is mounted and removed from the drawer.

What is claimed is:

1. An improved mounting device to secure a front panel (12) in perpendicular relationship onto a side panel (14), said improved mounting device comprising a mounting bracket (18) secured to the front panel (12) and a receiving bracket assembly (20) secured to the side panel (14), said front and side panel (12,14) forming part of a furniture characterized in that the improved mounting device comprises:

the mounting bracket (18) with a nose edge (32) removably secured onto the receiving bracket assembly (20) wherein the nose edge (32) includes a bottom face (33), a locking face (34) and a clamping face (35) having grooves provided thereon;

the receiving bracket assembly (20) comprises of a holding block (60) to receive in registration the nose edge (32), a slider (70) to securely hold the mounting bracket (18) and to allow linear movement of the mounting bracket (18) within the receiving bracket assembly (20), a rotatably mounted actuator plate (80), a biased means pivotally mounted to tension the actuator plate (80) and wherein by adjusting the actuator plate (80) and an eccentric cam mechanism means (110) the front panel (12) can be adjusted in two perpendicular axes in relation to the side panel (14).

2. The improved mounting device as claimed in claim 1 wherein the holding block (60) includes a recessed portion (63) with grooves.

3. The improved mounting device as claimed in claim 1 wherein the slider (70) includes an angular face (74) corresponding to the locking face (34) of the nose edge (32) and wherein when the front panel (12) is securely clamped to the side panels (14), both the angular face (74) and the locking face (34) are in registration.

4. The improved mounting device as claimed in claim 3 wherein a second tail end (85) of the actuator plate (80) is pivotally biased against a spring mechanism holding body (90) such that when the spring mechanism holding body (90) is in a first position, the swing arm (81) of the actuator plate (80) and the slider (70) are distal to the mounting bracket (18) and when the spring mechanism holding body (90) is rotated to a second position the swing arm (81) and the slider (70) are proximate to the mounting bracket (18) and wherein in the first position the slider (70) and the locking face (34) of the mounting bracket (18) are not locked in position and in the second position the slider (70) and the locking face (34) of the mounting bracket (18) are in a locked position.

5. The improved mounting device as claimed in claim 1 wherein the slider (70) is provided with an opening (73) and wherein a swing arm (81) of the actuator plate (80) is inserted therein.

6. The improved mounting device as claimed in any one of claims 1, 2, 3, 4 or 5 wherein the eccentric cam mechanism means (110) is operable to adjust the front panel (12) in one linear movement.

7. The improved mounting device as claimed in any one of claims 1, 2, 3, 4 or 5 wherein the eccentric cam mechanism means (110) is operable to adjust the front panel (12) in one linear movement and wherein actuator plate (80) is operable to adjust the front panel (12) in a perpendicular direction to the direction of the linear movement.

8. A drawer assembly, which includes the improved mounting device as claimed in any one of claims 1, 2, 3, 4 or 5.

* * * * *

UNITED STATES PATENT AND TRADEMARK OFFICE

CERTIFICATE OF CORRECTION

PATENT NO. : 6,981,752 B2
APPLICATION NO. : 10/440414
DATED : January 3, 2006
INVENTOR(S) : Lam et al.

It is certified that error appears in the above-identified patent and that said Letters Patent is hereby corrected as shown below:

At column 1, line 51, after the word “form”, delete “pact” and insert therefor --part--.

At column 3, line 51, after the word “opening”, delete the reference numeral “4.5” and insert therefor --(45)--.

At column 4, line 46, after the word “plate”, delete the reference numeral “(SO)” and insert therefor --(50)--.

At column 6, line 41, after the word “eccentric”, delete “Cant” and insert therefor --cam--.

ON THE TITLE PAGE

At Item ( 57), delete the originally filed abstract

“An improved mounting device to secure a front panel in perpendicular relationship onto a side panel comprises of a mounting bracket (18) secured to the front panel (12) and a receiving bracket (20) assembly secured to the side panel (14) said front and side panel (12,14) forming part of a furniture. The improvements further includes the mounting bracket (18) with a nose edge (32) removeably secured onto the receiving bracket assembly (20), the receiving bracket assembly (20) comprises of a holding block (60) to receive in registration the nose edge (32), a slider (70) to securely hold the mounting bracket (18) and to allow linear movement of the mounting bracket (18) within the receiving bracket (20), a rotatably mounted actuator plate (80), a biased means pivotally mounted to tension the actuator plate (80) and wherein by adjusting the actuator plate (80) and an eccentric cam mechanism means (110) the front panel (12) can be adjusted in two perpendicular axes in relation to the side panels (14).”

and insert therefor -- An improved mounting device to secure a front panel in perpendicular relationship onto a side panel comprises a mounting bracket (18) secured to the front panel (12) and a receiving bracket assembly (20) secured to the side panel (14) with the front and side panel (12, 14) forming part of a furniture. The mounting bracket (18) further includes a nose edge (32) removably secured onto the receiving bracket assembly (20). The receiving bracket assembly (20) comprises a holding block (60) to receive in registration the nose edge (32), a slider (70) to securely hold the mounting bracket (18) and to allow linear movement of the mounting bracket (18) within the receiving bracket (20) and a rotatably mounted actuator plate (80) that is pivotably biased at one end. By adjusting the actuator plate (80) and an eccentric cam mechanism (110), the front panel (12) can be adjusted in two perpendicular axes in relation to the side panel (14).--.

UNITED STATES PATENT AND TRADEMARK OFFICE

CERTIFICATE OF CORRECTION

PATENT NO. : 6,981,752 B2
APPLICATION NO. : 10/440414
DATED : January 3, 2006
INVENTOR(S) : Lam et al.

It is certified that error appears in the above-identified patent and that said Letters Patent is hereby corrected as shown below:

At section (75), delete the inventor name "Lian Lam Harn" and insert therefor --LAM, Harn Lian--.

At section (75), delete the inventor name "Yan Lam Harn" and insert therefor --LAM, Harn Yan--.

Signed and Sealed this

Tenth Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 6,981,752 B2
APPLICATION NO. : 10/440414
DATED : January 3, 2006
INVENTOR(S) : Lam et al.

It is certified that error appears in the above-identified patent and that said Letters Patent is hereby corrected as shown below:

IN THE SPECIFICATION

At column 1, line 9, after the words “member of”, delete “the”.

Signed and Sealed this

Twenty-third Day of October, 2007

JON W. DUDAS
*Director of the United States Patent and Trademark Office*